US006161476A

United States Patent [19]

Yoneoka

[11] Patent Number: 6,161,476

[45] Date of Patent: Dec. 19, 2000

[54] STENCIL PRINTER SYSTEM

[75] Inventor: Hideharu Yoneoka, Ibaraki-ken, Japan

[73] Assignee: Riso Kagaku Corporation, Tokyo, Japan

[21] Appl. No.: 09/258,424

[22] Filed: Feb. 26, 1999

[30] Foreign Application Priority Data

Feb. 27, 1998 [JP] Japan ..... 10-047645

[51] Int. Cl.[7] ..... B41L 13/00

[52] U.S. Cl. ..... 101/118; 101/484; 399/410

[58] Field of Search ..... 101/117, 118, 101/484; 270/58.08, 58.09; 399/407, 410

[56] References Cited

U.S. PATENT DOCUMENTS

| | | | |
|---|---|---|---|
| 5,598,258 | 1/1997 | Sato et al. | 399/410 |
| 5,690,324 | 11/1997 | Otomo et al. . | |
| 5,852,765 | 12/1998 | Yamashita et al. | 399/407 |

FOREIGN PATENT DOCUMENTS

| | | |
|---|---|---|
| 0 807 535 A2 | 11/1987 | European Pat. Off. . |
| 0 571 194 A1 | 11/1993 | European Pat. Off. . |
| 4-43089 | 2/1992 | Japan . |

*Primary Examiner*—Ren Yan

*Attorney, Agent, or Firm*—Nixon Peabody LLP; Donald R. Studebaker

[57] ABSTRACT

A stencil printer system includes a stencil printer unit. The printer unit is provided with a master making system which makes a stencil master on the basis of an image read out from an original, a printing system which makes copies of the original by transferring ink to printing sheets through the stencil master, an original conveyor which conveys originals placed in a predetermined position to the master making system one by one, and an original detector which detects whether an original exists in the predetermined position. A post handling unit including a sorter and a stapler is connected to the printer unit. A first mode setting key is manually operable to set the printer unit to a continuous printing mode in which the printer unit repeats making a master and printing copies of the original so long as the original detector detects existence of an original in the predetermined position. A second mode setting key is manually operable to set the post handling unit to one of a stapling mode and a non-stapling mode. The first mode setting is caused to set the printer unit to the continuous printing mode when the second mode setting key is operated to set the post handling unit to the stapling mode.

4 Claims, 16 Drawing Sheets

START
F91
MASTERMODE/PRINTING MODE SET
F92
RM=0?
YES
NO
MASTER MODE SET
F93
SORTER MODE SET
F94
MD=0?
YES
NO
NON-SORT PRINTING MODE SET
F95
MD=1?
YES
NO
F83
ADF CONNECTED
NO
YES
F97
AUTO-STAPLING SET
F98
ST=0?
YES
NO
F81
RN=1 LED LIT
F96
MD=2?
NO
YES
F99
ORIGINALS IN ADF
NO
YES
SORTING, CON. PRINTING AUTO-STAPLING
DRY MODE, PRINTING
GROUP MODE, PRINTING
SORTING, PRINTING

STENCIL PRINTER SYSTEM

BACKGROUND OF THE INVENTION

1. Field of the Invention

This invention relates to a stencil printer system, and more particularly to a stencil printer system provided with a post handling system for distributing recorded sheets discharged from a printer to a plurality of bins.

2. Description of the Related Art

There has been wide known a stencil printer system comprising a master making means which forms an image-wise pattern of perforations on a master blank, thereby making a stencil master, and a printing means in which the stencil master is wound around a printing drum having an ink-permeable outer peripheral wall and ink is transferred to printing papers through the stencil master, the master making means and the printing means being integrated into a unit.

Such a stencil printer system is often combined with various post handling systems such as a sheet sorter.

As disclosed, for instance, in Japanese Unexamined Patent Publication No. 4(1992)-43089, there has been known a sheet sorter in which a plurality of recorded sheets discharged from an image recording apparatus such as a printer, a copier or the like are distributed to a plurality of bins in sequence to form a stack of sheets on each bin. Such a sheet sorter is provided with a first sheet transfer system which transfers the recorded sheets discharged from the image recording apparatus to the vicinity of the uppermost bin, a second sheet transfer system which receives the recorded sheets from the first sheet transfer system and is able to transfer the sheets to the vicinity of the lowermost bin and an indexer which receives the sheets from the second sheet transfer system and is movable up and down along the array of sheet inlet ends of the bins to distribute the sheets to the respective bins through the sheet inlet ends thereof. Further there has been known a sheet sorter which is further provided with a stapling means which staples the stack of sheets in each bin. The sheet sorter provided with a stapling means is generally arranged so that the user can switch the operating mode of the sheet sorter between a stapling mode for effecting stapling and a non-stapling mode for not effecting stapling.

Such a sheet sorter is sometimes provided with a plurality of operating modes. As typical operating modes, there have been known a "sorting mode" in which copies are stacked in each bin page by page and the copies stacked in each bin in order of the pages are bound together, a "group mode" in which copies of the same original are stacked in the same bin, and a "dry mode" in which the copies are distributed in sequence to the respective bins each to one bin until the number of copies reaches the number of the bins and when the number of copies exceeds the number of the bins, the copies are distributed in sequence from the first bin to the respective bins each to one bin to be stacked on the preceding copy so that the intervals at which the copies in each bin are superposed one on another are elongated and the back side of the upper copy is not stained with wet ink on the lower copy. The aforesaid stapling is generally effected when the sort mode is selected.

In the stencil printer system provided with a sorter with a stapling means, when the user selects the sort mode and the stapling mode and copies of a plurality of originals are stacked and stapled together, it is necessary to detect that printing of a last original is ended. This detection can be effected by setting originals to an automatic document feeder which feeds the originals one by one to the master making means and detecting that all the originals set to the automatic document feeder have been fed to the master making means.

When copies of an original are to be printed, the user generally must set the stencil printer system to the master making mode to make a stencil master and then must operate the stencil printer system again to set the system to the printing mode. However, copies of a plurality of originals are to be printed, it is troublesome for the user to set the stencil printer system to the master making mode and to the printing mode for each original. Accordingly, some stencil printer systems are provided with a continuous printing mode for automatically effecting printing following the master making step. By using the continuous printing mode in combination with an automatic document feeder, the master making step and the printing step can be automatically repeated so long as there remains an original in the automatic document feeder.

However even if the user sets a plurality of originals to the automatic document feeder and sets the stencil printer system to the stapling mode, setting to the stapling mode will become vain when the user forgets to set the system to the continuous printing mode since in this case the automatic document feeder feeds out only one of the originals. Further it is troublesome for the user to set both the stapling mode and the continuous printing mode.

SUMMARY OF THE INVENTION

In view of the foregoing observations and description, the primary object of the present invention is to provide a stencil printer system in which both the stapling mode and the continuous printing mode can be set by a simple operation.

In accordance with the present invention, there is provided a stencil printer system comprising a stencil printer unit including a master making means which makes a stencil master on the basis of an image read out from an original, a printing means which winds the stencil master around a printing drum and makes copies of the original by transferring ink to printing sheets through the stencil master, an original conveyor means which conveys originals placed in a predetermined position to the master making means one by one and discharges each of the originals from the master making means after the image thereon is read out, and an original detecting means which detects whether an original exists in the predetermined position, and a post handling unit including a sorting means which distributes the copies of the originals discharged from the stencil printer unit to a plurality of bins and forms a stack of the copies in each bin and a stapling means which staples the stack of the copies in each bin, wherein the improvement comprises a first mode setting means which is manually operable to set the stencil printer unit to a continuous printing mode in which the stencil printer unit repeats making a stencil master on the basis of an image read out from an original and printing copies of the original for a plurality of originals placed in the predetermined position, a second mode setting means which is manually operable to set the post handling means to one of a stapling mode for effecting stapling the stack of the copies in each bin and a non-stapling mode for not effecting stapling the stack of the copies, and a control means which causes the first mode setting means to set the stencil printer unit to the continuous printing mode when the second mode setting means is operated to set the post handling means to the stapling mode.

In the stencil printer system of the present invention, since the stencil printer unit is automatically set to the continuous printing mode when the second mode setting means is operated to set the post handling means to the stapling mode, a plurality of originals can be surely printed and the stack of the copies in each bin can be surely stapled by simply operating the second mode setting means to set the post handling means to the stapling mode even if the user forgets to operate the first mode setting means.

It is preferred that the stencil printer system be further provided with a counting means for counting the number of the originals placed in the predetermined position and the control means inhibits the post handling unit from effecting stapling the stack of the copies even if the second mode setting means has been operated to set the post handling means to the stapling mode when the number of the originals counted by the counting means is one.

With this arrangement, the post handling unit is prevented from stapling a single copy.

DESCRIPTION OF THE PREFERRED EMBODIMENT

Figure 1:
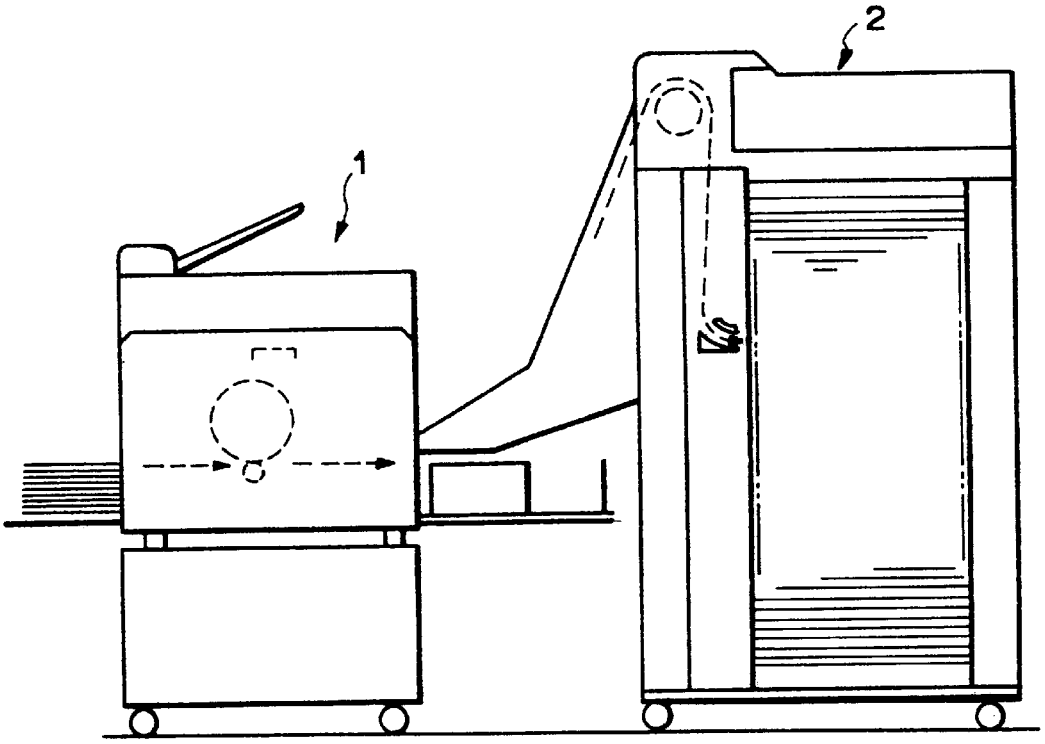
FIG. 1 is a view showing an appearance of a stencil printer system in accordance with an embodiment of the present invention.

As shown in FIG. 1, a stencil printer system in accordance with an embodiment of the present invention comprises a stencil printer unit 1 with a master making system and a sheet sorter 2 as a post handling unit.

Figure 2:
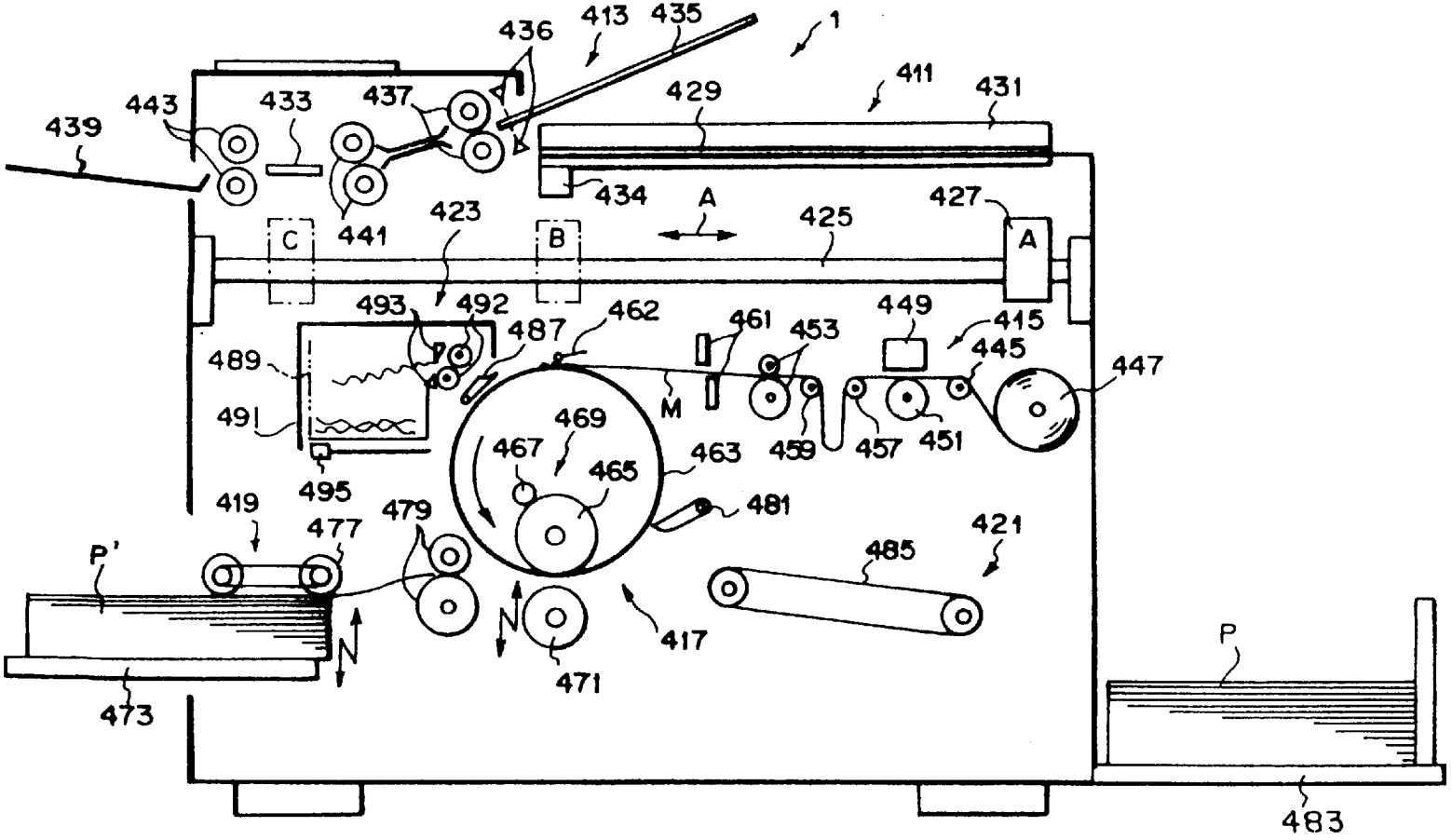
FIG. 2 is a view showing the structure of the stencil printer unit employed in the stencil printer system.

As shown in FIG. 2, the stencil printer unit 1 comprises an original readout system 411, an automatic document feeder 413, a master making system 415, a printing system 417, a paper supply system 419, a copy discharge system 421 and a master discharge system 423.

The original readout system 411 comprises a line image sensor 427 which is supported on a guide rail 425 to be movable back and forth in a horizontal direction as shown by double-headed arrow A, an original support table 429 which is formed of a transparent glass plate and on which a book-shaped original or the like is manually placed, a pressure plate 431 which is provided on the original support table 429 to be opened and closed, a target glass plate 433 on which originals are fed by the automatic document feeder 413, and a first original sensor 434 which detects that an original is set on the original support plate 433. The line image sensor 427 is moved by a drive system (not shown) along the guide rail 425 between the home position indicated at A and the scan end position indicated at B to scan the original on the original support plate 433 at a predetermined speed when the image of the original placed on the support plate 433 is to be read out. When the image of the original fed by the automatic document feeder 413 is to be read out, the line image sensor 427 is moved to the position indicated at C just below the target glass plate 433 and is held there.

The automatic document feeder 413 comprises an original setting tray 435 on which a stack of originals is set, a pair of original pickup rollers 437 which feed the originals on the original setting tray 435 to the target glass plate 433 one by one, an original discharge tray 439 on which the originals are discharged after being finished with image reading, a pair of original feed rollers 441 which are disposed upstream of the target glass plate 433 and feed the originals at a predetermined speed, a pair of original feed rollers 443 which are disposed downstream of the target glass plate 433 and feed the originals from the target glass plate 433 to the original discharge tray 439, and a second original sensor 436 which optically detects that an original is set on the original setting tray 435.

The originals set on the original setting tray 435 of the automatic document feeder 413 are picked up one by one by the original pickup rollers 437 and fed to the target glass plate 433 by the original feed roller 441. While the originals are passed over the target glass plate 433, the line image sensor 427 fixedly positioned below the target glass plate 433 reads out the images of the originals. Thereafter the originals are discharged onto the original discharge tray 439 by the original feed rollers 443.

The master making system 415 comprises a master blank roll support portion 447 which supports a roll of master blank in continuous length, a thermal head 449 comprising an array of point heater elements linearly extending in a direction transverse to the direction of conveyance of the master blank, a platen roller 451 which is positioned opposed to the thermal head 449, a pair of master blank feed rollers 453, master blank guide rollers 445, 457 and 459 and a cutter 461. An image signal representing the image read out by the line image sensor 427 is input into the master making system 415 and the point heater elements of the thermal head 449 are selectively energized according to the image signal, whereby an image in the form of a dot matrix is formed on the master blank. Then a stencil master M thus formed is cut from the master blank by the cutter 461.

The printing system 417 comprises a printing drum 463 which has an ink-permeable outer peripheral wall and is rotated about its axis in the counterclockwise direction (as seen in FIG. 2), an ink squeezer mechanism 469 including a squeegee roller 465 and a doctor rod 467 disposed inside the printing drum 463 and a press roller 471 which presses a printing paper P' against the ink squeezer mechanism 471. The stencil master M is wound around the printing drum 463 with its one end clamped by a clamp 462.

The paper supply system 419 comprises a paper supply table 473 on which a stack of printing papers P' is placed, a paper supply roller 477 which takes out the printing papers P' one by one and a pair of timing rollers 479 which feeds out the printing papers P' between the printing drum 463 and the press roller 471.

Figure 3A:
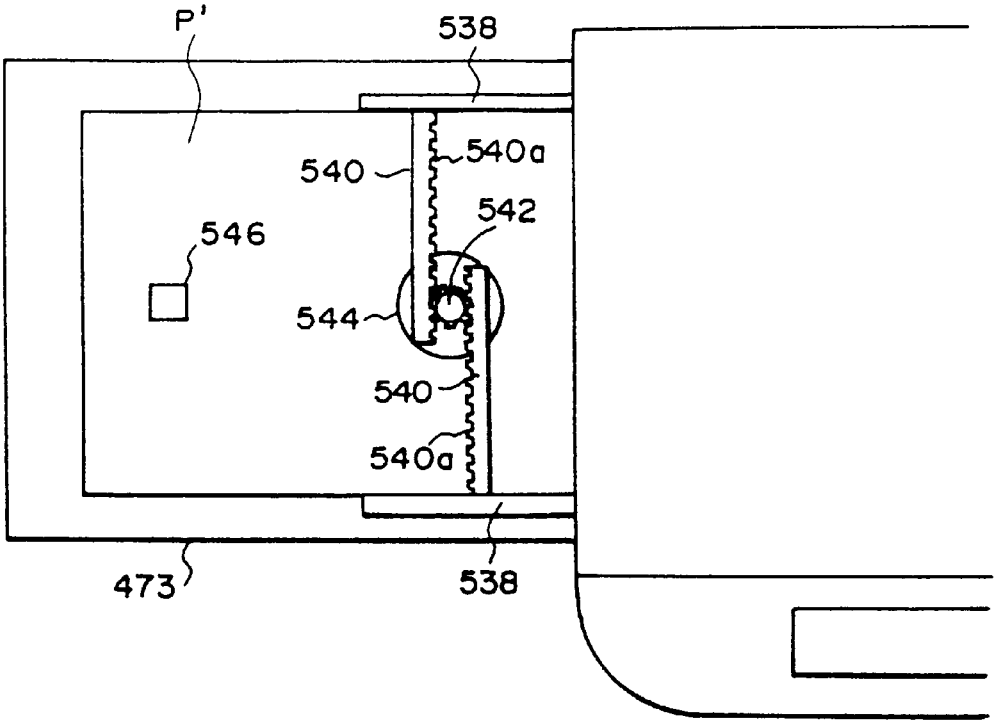
FIG. 3A is a plan view of the paper supply table.
Figure 3B:
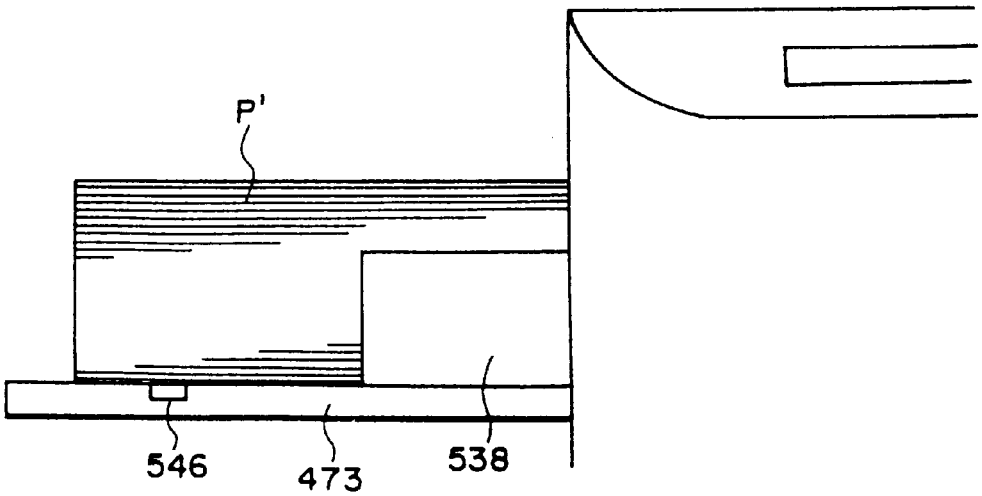
FIG. 3B is a side view of the paper supply table.

As shown in FIGS. 3A and 3B, a pair of guide plates 538 which are respectively brought into abutment against the side edges of the stack of the printing papers P' to locate and guide the printing papers P' are positioned on opposite sides of the paper supply table 473. Each guide plate 538 is provided with a rod 540 which is provided with a rack 540*a* and is disposed inside the paper supply table 473. The rods 540 extend toward each other transversely to the direction of feed of the printing papers P' and are in mesh with a pinion 542 disposed at the middle between the guide plates 538 on the front end of the paper supply table 473.

A potentiometer 544 whose output voltage changes with rotation of the pinion 542 is mounted on a lower portion of the shaft of the pinion 542. When the guide plates 538 are moved toward and away from each other so that the guide plates 538 are brought into contact with the respective side edges of the stack of the printing papers P', the pinion 542 is rotated by way of the racks 540*a* of the rods 540 and the output of the potentiometer 544 changes. Accordingly by detecting the output of the potentiometer 544, the width of the printing paper P' can be detected.

A paper sensor 546 for detecting presence and absence of the printing paper P' on the paper supply table 473 is provided on a rear end portion of the paper supply table 473 at the middle between the side edges of the table 473. The paper sensor 546 also detects whether the length of the printing paper P' set on the paper supply table 473 is larger than a predetermined value. In this specification, the dimension of the printing paper P' as measured in the direction of feed of the printing paper P' is referred to as the length of the printing paper P' and that as measured in the direction transverse to the direction of feed of the printing paper P' is referred to as the width of the printing paper P'. The size of the printing paper P' set on the paper supply table 473 is detected by the potentiometer 544 and the paper sensor 546 and paper size information, such as a regular size or irregular side, is obtained.

The copy discharge system 421 comprises a copy peeler member 481 which peels a copy (printed paper) P from the printing drum 463, a non-sort sheet discharge table 483 on which the copies P are stacked, and a copy conveyor mechanism 485 in the form of a belt conveyor which conveys the copies P peeled from the printing drum 463 to the non-sort sheet discharge table 483.

The master discharge system 423 comprises a master peeler member 487 which peels the master M from the printing drum 463, a master box 489 which receives the stencil masters M peeled from the printing drum 463 and is removably supported on a box support 491, and a pair of rollers 492 which convey the stencil masters M peeled from the printing drum 463 to the master box 489. A photoelectric master discharge sensor 493 is disposed at the inlet to the master box 489 to detect that the master M is fed in the master box 489. The master discharge system 423 is further provided with a master box set switch 495 which detects the master box 489 is set on the box support 491.

When printing is carried out, the printing drum 463 is rotated in the counterclockwise direction in FIG. 2 and a printing paper P' is fed between the printing drum 463 and the press roller 471 from the paper supply table 473 by the timing rollers 479 at a predetermined timing in synchronization with rotation of the printing drum 463. The printing paper P' is pressed against the printing drum 463 by the press roller 471 and ink is transferred to the printing paper P' through the stencil master M, whereby printing is effected.

The copy P thus obtained is peeled from the printing drum 463 by the copy peeler member 481 and conveyed to the non-sort sheet discharge table 483 by the copy conveyor mechanism 485 and is stacked on the table 483 with its printed surface facing upward. After printing, the stencil master M is peeled from the printing drum 463 by the master peeler member 487 and conveyed to the master box 489 by the rollers 492.

Figure 4:
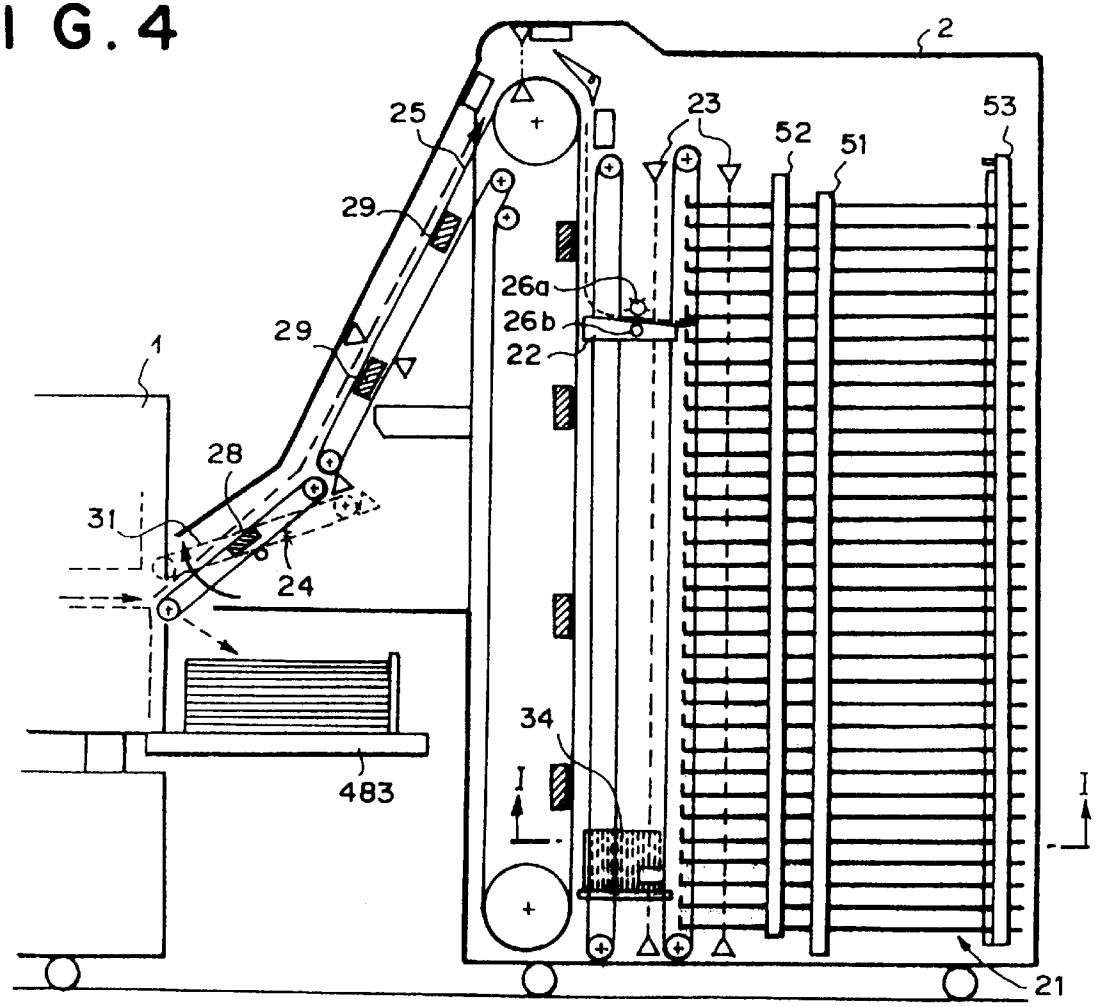
FIG. 4 is a view showing the structure of the sheet sorter unit employed in the stencil printer system.

The sheet sorter 2 will be described with reference to FIG. 4, hereinbelow. As shown in FIG. 4, the sheet sorter 2 comprises a bin array 21, an indexer 22 which inserts the copies P into the bins in the bin array 21, an indexer sensor 23 which detects that the copies P are surely inserted into the bins, and a pair of conveyor belts 24 and 25 which convey the copy P discharged from the stencil printer unit 1 to the bin array 21.

The indexer 22 is driven by a DC servomotor (not shown) and is moved in order to insert the copies P into the bins in sequence while the indexer sensor 23 detects that each copy P is surely inserted into each bin. The indexer 22 is provided with a pair of rollers 26*a* and 26*b*, and when the upper roller 26*a* is moved downward into contact with the lower roller 26*b*, the copy P conveyed to between the rollers 26*a* and 26*b* is pinched therebetween and conveyed into the bin, whereby even a soft and hard-to-convey copy P can be surely conveyed into the bin. Further when the surface of the upper roller 26*a*, which is brought into contact with the upper surface of the copy P bearing thereon ink, is provided with needle-like projections, stain of the surface with ink can be minimized. Further by removing the upper roller 26*a* from the lower roller 26*b*, stain with ink of the upper surface of the copy P can be prevented.

The conveyor belts 24 and 25 are driven by a DC motor not shown. The conveyor belts 24 and 25 are provided with suction fans 28 and 29 for attracting the copy P against the conveyor belt 24 and 25. The conveyor belt 24 and the suction fan 28 form a conveyance mode switching passage 31. The conveyance mode switching passage 31 can be moved between the position shown by the solid line in FIG. 4 and the position shown by the dashed line in FIG. 4. When the conveyance mode switching passage 31 is in the position shown by the broken line, the copies P discharged from the stencil printer unit 1 are fed to the non-sort sheet discharge table 483 passing below the switching passage 31. On the other hand, when the conveyance mode switching passage 31 is in the position shown by the solid line, the copies P are conveyed to the sheet sorter 2 by the conveyor belts 24 and 25. In the initial state, the conveyance mode switching passage 31 is in the position shown by the broken line and the stencil printer system is set to the non-sorting mode in which the copies P need not be sorted, the conveyance mode switching passage 31 is held in the position shown by the dashed line. When the stencil printer system is set to the sorting mode, the group mode or the dry mode, the switching passage 31 is moved to the position shown by the solid line and is returned to the initial position after sorting of the copies P is ended.

The sheet sorter 2 is further provided with lineup rods 51, 52 and 53 which are driven by a pulse motor (not shown) to line up the copies P in the bins and a stapler 34 which is driven up and down by a pulse motor (not shown) and staples the stack of copies P in each bin from the copies in the uppermost bin.

Figure 5:
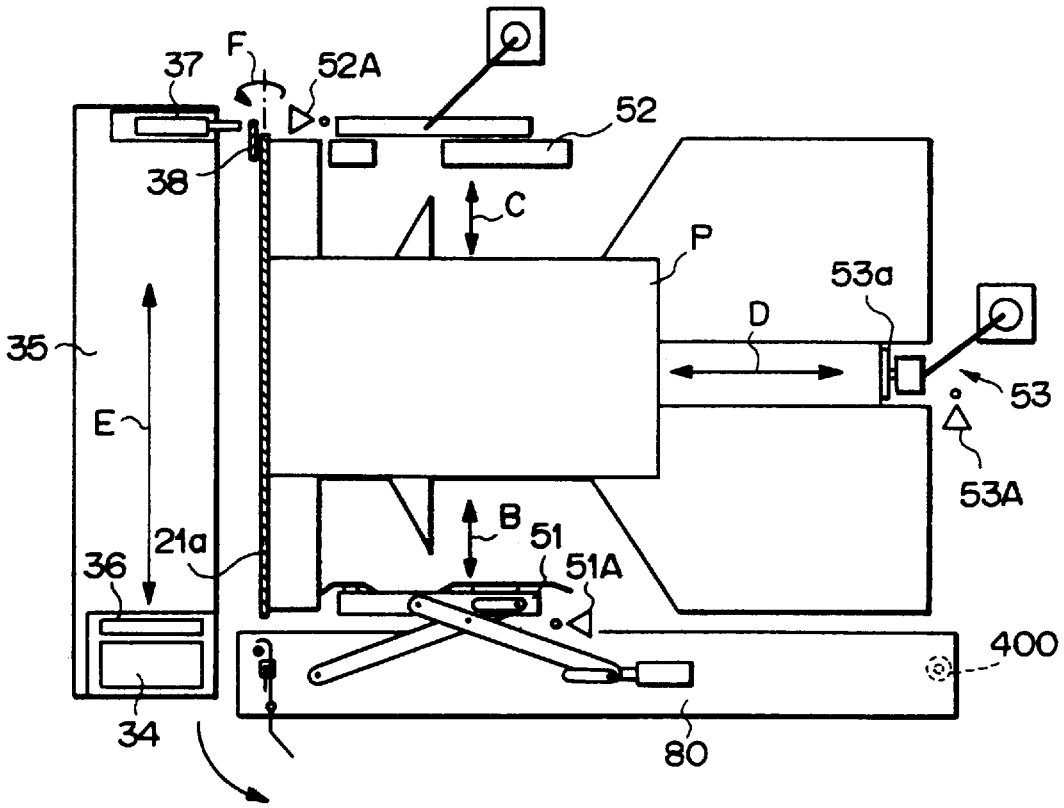
FIG. 5 is a cross-sectional view taken along line I—I in FIG. 4 showing the bin, the sheet lineup rods and the stapler.

As shown in FIG. 5, the lineup rods 51 and 52 are movable back and forth in a direction transverse to the direction of conveyance of the copies P as shown by double-headed arrows B and C. The lineup rods 51 and 52 are brought into abutment against the side edges of the stack of copies P in each bin, thereby lining up the side edges of the copies in the stack and centering the stack of the copies in the bin. The lineup rod 53 is movable back and forth in the direction of conveyance of the copies P as shown by double headed arrow D. The lineup rod 53 is brought into abutment against the leading edge of the stack of the copies P in each bin and presses the trailing edge of the stack of the copies P in the bin against an erected face 21*a*, thereby lining up the copies P in the stack in the direction of conveyance of the copies P. The erected face 21*a* is mounted for rotation on the trailing edge of each bin and is urged in the direction opposite to the direction of arrow F by an urging means (not shown). The erected face 21*a* is rotatable between a vertical position where it erects vertically with respect to the upper surface of the bin and a horizontal position where it extends in flush with the upper surface of the bin. The erected face 21*a* is normally held in the vertical position by the urging means. A lever 38 is fixed to the erected face 21*a*, and when a stapler unit 35 (to be described later) is moved downward with a solenoid 37 (to be described later) held on, a movable member which is projected when the solenoid 37 is turned on pushes downward the lever 38 and rotates the erected face 21*a* to the horizontal position. Home position sensors 51A, 52A and 53A detect whether the lineup rods 51, 52 and 53 are in the respective home positions.

The stapler 34 and a pusher 36 which pushes the stapled stack of the copies P back into the bin are mounted in the stapler unit 35 to be movable back and forth as shown by double-headed arrow E. The aforesaid solenoid 37 is mounted in the stapler unit 35.

After the stacks of the copies P in all the bins are completed, stapling is initiated. The indexer 22 is retracted above the bin array 21 and the stapler unit 35 is first moved to a position above the uppermost bin by a distance substantially equal to the height of one bin (this position will be referred to as "the 0-th bin position", hereinbelow). Then the stapler unit 35 is lowered to the first (uppermost) bin with the solenoid 37 held on, whereby the erected face 21*a* of the first bin is rotated to the horizontal position. Thereafter an ejector 53*a* mounted on the lineup rod 53 is moved to the first bin and the lineup rod 53 is moved toward the stack of the copies P, whereby the ejector 53*a* ejects the stack of the copies P toward the stapler unit 35. The stapler 34 staples the copies P ejected by the ejector 53*a*. After the copies P in the first bin are stapled, the pusher 36 pushes the stapled copies P back into the first bin and the solenoid 37 is turned off to return the erected face 21*a* of the first bin to the vertical position. Then the stapler unit 35 is lowered to the second bin with the solenoid 37 on. By repeating this procedure, stapling is effected for all the bins in which the copies P are stacked.

Figure 6:
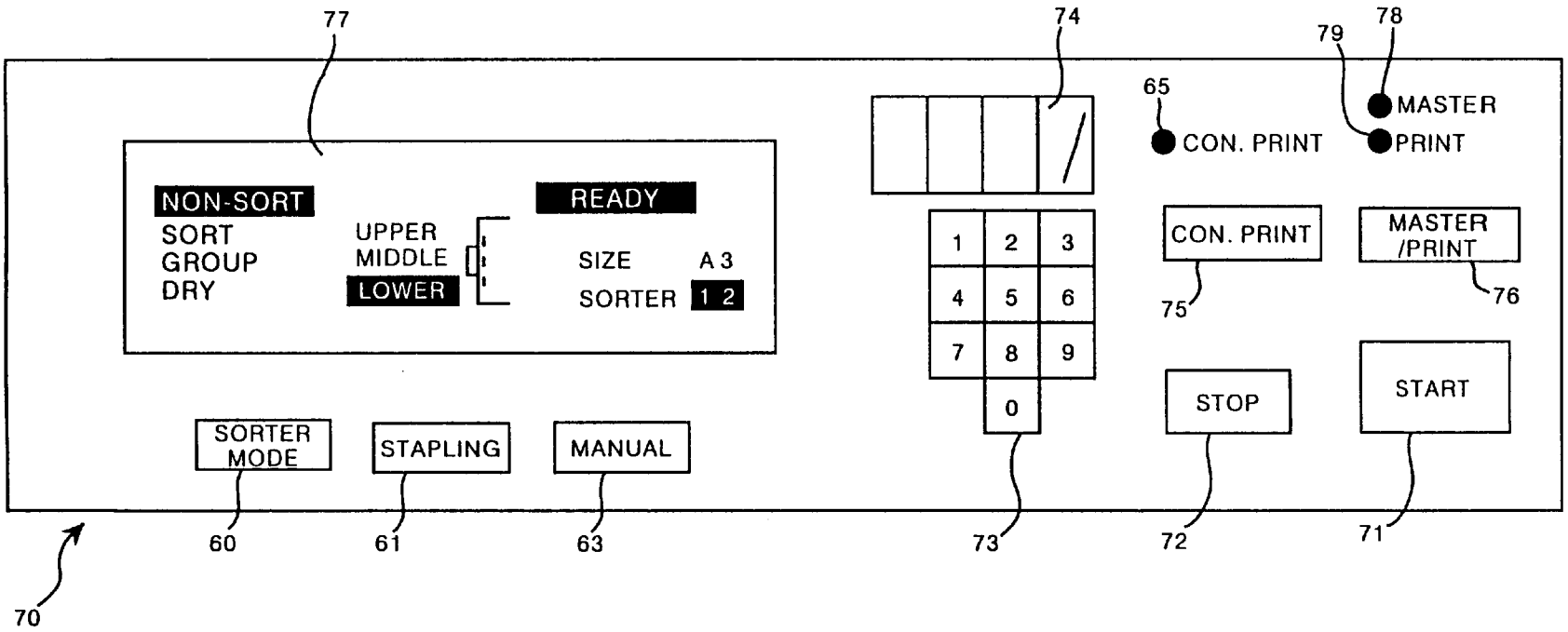
FIG. 6 is a view showing the control panel of the stencil printer system.

FIG. 6 shows a control panel 70 of the stencil printer unit 1. The control panel 70 is provided with a ten-key pad 73, a copy number LED 74, a display 77 which may comprise, for instance, a liquid crystal panel, a sorter mode key 60, a stapling key 61, a manual mode key 63, a start key 71, a master making/printing key 76, a continuous printing key 75, a master making mode LED 78, a printing mode LED 79 and a continuous printing LED 65.

The ten-key pad 73 comprises 0 to 9 digit keys and is used when setting, for instance, the number of copies to be printed.

The copy number LED 74 displays the number of copies to be printed set through the ten-key pad 73. The number displayed by the copy number LED 74 is decremented one by one each time the stencil printer unit 1 discharges one copy P.

The display 77 displays an error message upon occurrence of error such as jamming and the size of the sheet on the paper supply table 473. Further the display 77 displays use and non-use of the sheet sorter 2, the mode of the stapler currently set, the current operating state of the printer unit 1 and the mode of the sheet sorter 2 currently set. The mode of the stapler currently set and the mode of the sheet sorter currently set are highlighted.

The sorter mode key 60 is operated to select one of a non-sort mode (the sheet sorter 2 is not used and the copies P are discharged onto the non-sort discharge table 483), and three modes of the sheet sorter 2, the sorting mode, the group mode and the dry mode. Each time the sorter mode key 60 is pressed, the mode selected is switched from the non-sort mode to the sorting mode, to the group mode and to the dry mode in this order.

The stapling key 61 is operated when stapling is automatically effected by the stapler 34 after the copies P in each bin is lined up. Each time stapling key 61 is pressed, the mode of the stapler selected is switched from single stapling at a lower portion to double stapling at the middle, to single stapling at an upper portion in this order and to non-stapling.

The manual mode key 63 is pressed when manually directing the sheet sorter 2 to staple the copies P after lining up the copies is ended.

The start key 71 is pressed to start the stencil printer unit 1 and the sheet sorter 2.

The stop key 72 is pressed to stop the stencil printer unit 1 and the sheet sorter 2.

The master making/printing key 76 is for switching the master making operation and the printing operation. The master making mode LED 78 is lit when the master making mode is selected and the printing mode LED 79 is lit when the printing mode is selected.

The continuous printing key 75 is operated to set the stencil printer unit 1 to the continuous printing mode in which the stencil printer unit 1 repeats making a stencil master on the basis of an original and printing copies of the original so long as there is an original on the original support table 429 or the original setting tray 435. When the continuous printing mode is selected, the continuous printing LED 65 is lit.

In this embodiment, the automatic stapling mode is selected by the stapling key 61 and the second original sensor 436 detects that an original is set on the original setting tray 435, the continuous printing mode is automatically selected even if the continuous printing key 75 is not pressed.

The control circuit of this embodiment will be described with reference to FIG. 7, hereinbelow.

Figure 7:
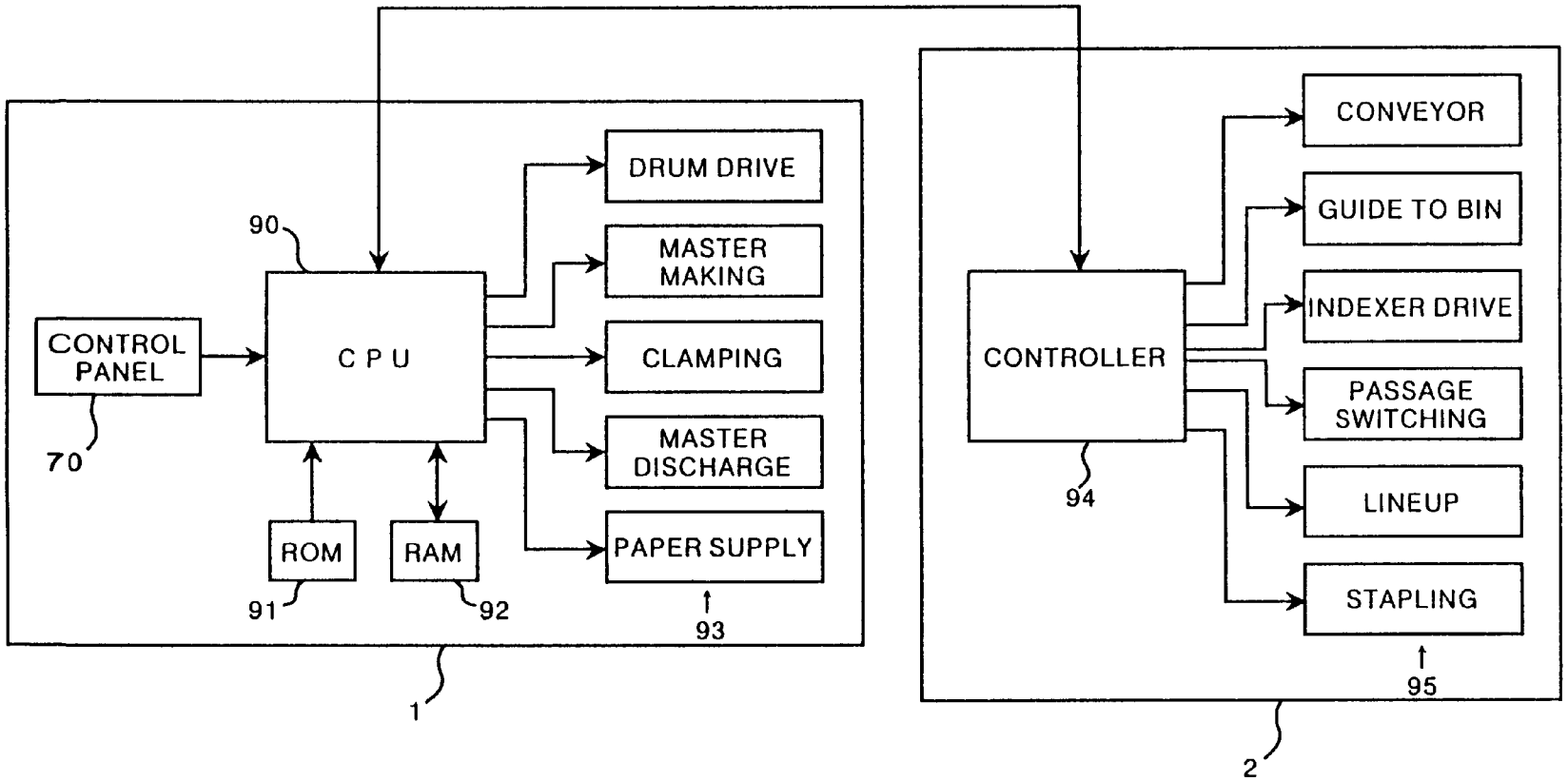
FIG. 7 is a block diagram for illustrating the control circuit of the stencil printer system.

As shown in FIG. 7, the control circuit of the stencil printer system of this embodiment comprises a CPU 90 which controls the mechanisms 93 in the stencil printer unit 1 such as the printing drum drive mechanism, the master making system, the master clamping mechanism, the master discharge system, the paper supply system and the like and a controller of the sheet sorter 2 on the basis of programs stored in a ROM 91 according to the command from the control panel 70. The controller 94 of the sheet sorter 2 controls mechanisms in the sheet sorter 2 such as the copy conveyor mechanism for introducing the copies into the sheet sorter 2, a copy guide mechanism for guiding the copies to the bins, an indexer drive mechanism for moving up and down the indexer, the passage switching mechanism, the copy lineup mechanism, the stapling mechanism and the like according to the command from the CPU 90. The CPU 90 is provided with a RAM 92 in which the contents of setting input from the control panel 70 such as the number of copies, the selected sorter mode and the like are stored.

The operation of the stencil printer system of this embodiment will be described, hereinbelow. In the following description, the number of the bins in the bin array 21 will be supposed to be 20 for the purpose of simplicity.

Figure 8:
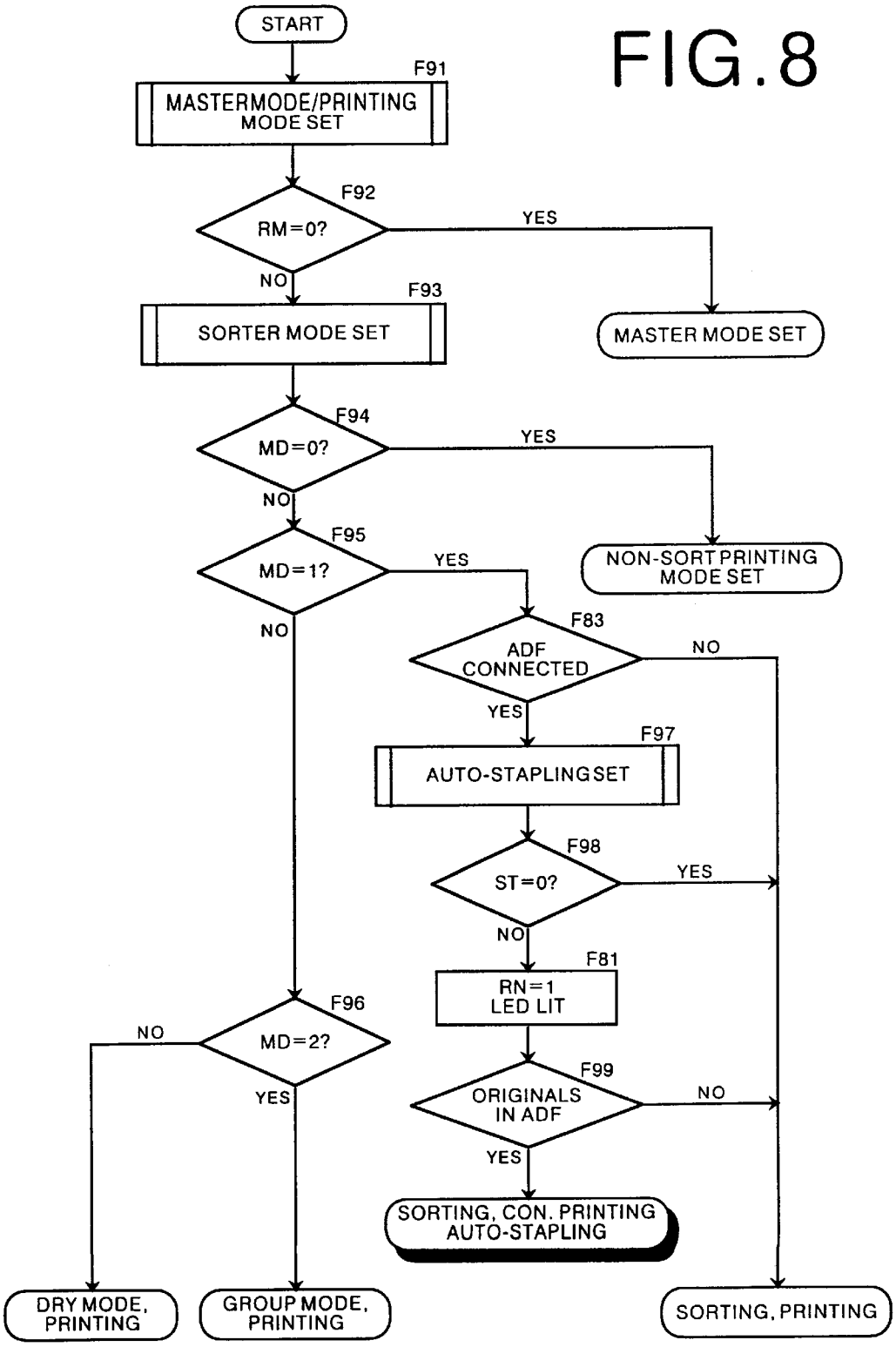
FIG. 8 is a flow chart for illustrating the operating mode setting processing in the waiting condition.

FIG. 8 shows a flow chart for illustrating setting of the operation modes in the standby state of the sheet sorter 2. The master making mode or the printing mode is selected through the master making/printing key 76 on the control panel 70. (step F91) When the master making mode is selected in step F91, register RM is set to "0" and when the printing mode is selected, the register RM is set to "1". In step F92, it is determined whether RM=0. When RM=0, the stencil printer unit 1 is set to the master making mode. When RM≠0, the sorter mode is selected through the sorter mode key and register MD is set to "0" when the non-sort mode is selected, to "1" when the sorting mode is selected, to "2" when the group mode is selected and to "3" when the dry mode is selected. (step F93) In step F94, it is determined whether MD=0. When MD=0, the stencil printer system is set to the non-sort printing mode. When MD≠0, it is determined whether MD=1 in step F95. When MD=1, it is determined whether the automatic document feeder 413 has been connected to the stencil printer unit 1. (step F83) When it is determined that the automatic document feeder 413 has been connected to the stencil printer unit 1, the stapling key 61 becomes operative and it becomes feasible to select the automatic stapling mode in step F97. When it is determined that the automatic document feeder 413 has not been connected to the stencil printer unit 1, the automatic stapling mode is not set. This is because it is impossible to know the end of printing of the last original if printing is effected without use of the automatic document feeder 413.

In step F98, it is determined whether register ST to be described later has been set to 0. When it is determined that ST≠0, the continuous printing mode is set, register RN is set to "1", and the continuous printing mode LED 65 is lit. (step F81) Then it is determined in step F99 whether originals have been set to the automatic document feeder 413. When it is determined in step F99 that no original have been set to the automatic document feeder 413, the continuous printing mode is canceled and when it is determined in step F98 that ST=0, the automatic stapling mode is not set. In these cases, though sorting is effected, stapling is not effected.

Thus in this embodiment, when the automatic stapling mode is selected, the stencil printer system is automatically set to the continuous printing mode even if the user forgets to select the continuous printing mode.

Though, in this embodiment, the continuous printing mode is once set when the automatic stapling mode is selected and is released when it is determined in step F99 that no original have been set to the automatic document feeder 413, it is possible to arrange the system so that the continuous printing mode is set when the automatic stapling mode is selected and at the same time it is determined that originals have been set to the automatic document feeder 413.

When MD=2 (step F96), the group mode and the printing mode are set, and when MD=3, the dry mode and the printing mode are set.

Figure 9:
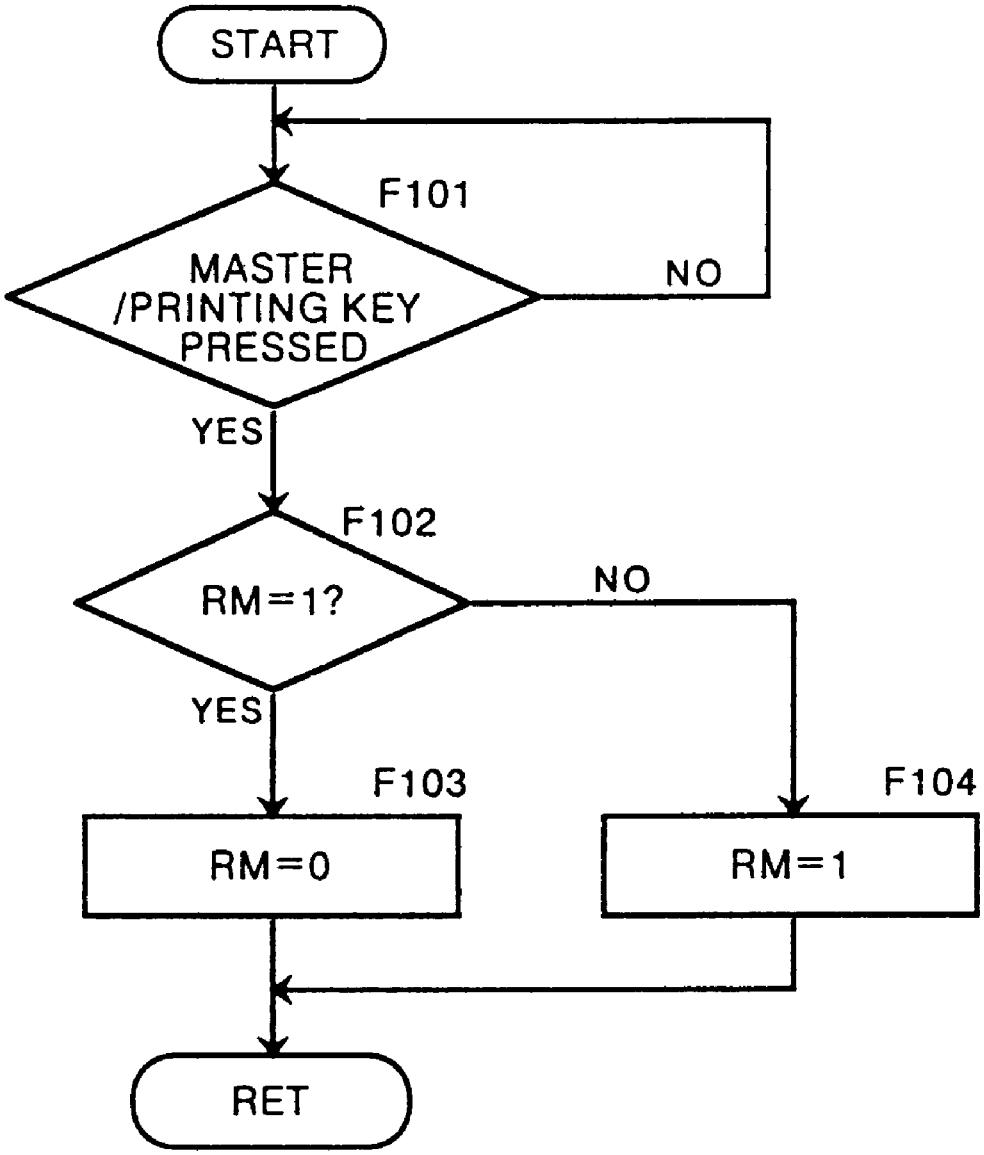
FIG. 9 is a flow chart for illustrating the master making/printing mode setting processing.

FIG. 9 is a flow chart for illustrating in detail the processing to be executed in step F91 of FIG. 8. In step F101, it is determined whether the master making/printing key 76 is pressed. When it is determined that the master making/printing key 76 is pressed, the register RM is changed to "0" when it has been "1" to switch the mode from the printing mode to the master making mode and to "1" when it has been "0" to switch the mode from the master making mode to the printing mode. (steps F102 to F104) The initial value of the register RM is set to "1".

Figure 10:
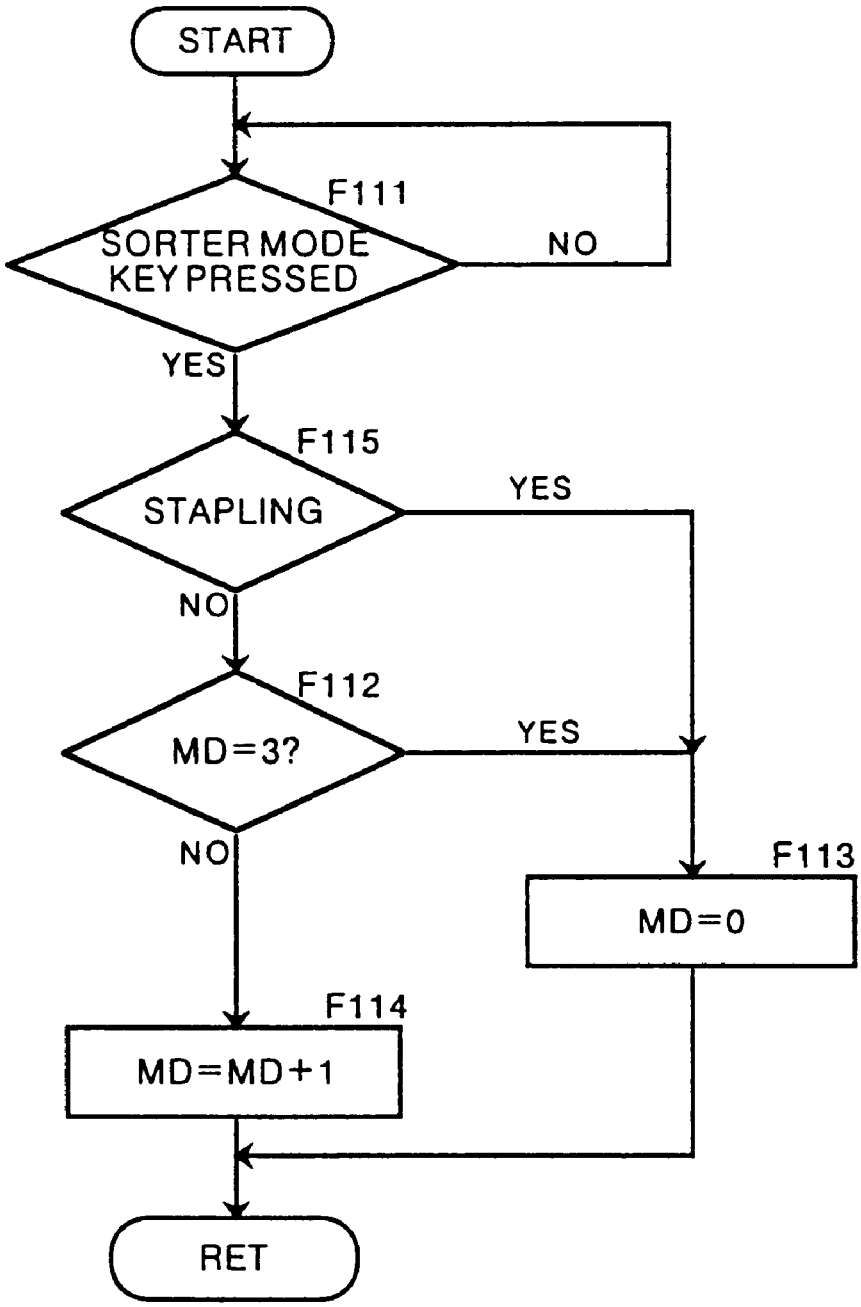
FIG. 10 is a flow chart for illustrating the sorting mode setting processing.

FIG. 10 is a flow chart for illustrating in detail the processing to be executed in step F93 of FIG. 8. When the sorter mode key 60 is pressed (step F111=YES) and it is determined in step F115 that the sheet sorter 2 is in stapling operation, the sorter mode is fixed to the non-sort mode (MD=0) in step F113 since sorting is not effected while the sorter 2 is in stapling operation. When it is determined that the sheet sorter 2 is not in stapling operation and it is determined in step F112 that MD=3, the register MD is changed to "0" to change the mode from the dry mode to the non-sort mode in step F113. When it is determined in step F112 that MD≠3, the value of the register MD is incremented by 1 in step F114. That is, when the mode has been set to the non-sort mode (MD=0), the mode is changed to the sorting mode (MD=1), when the mode has been set to the sorting mode, the mode is changed to the group mode (MD=2), and when the mode has been set to the group mode, the mode is changed to the dry mode (MD=3).

Figure 11:
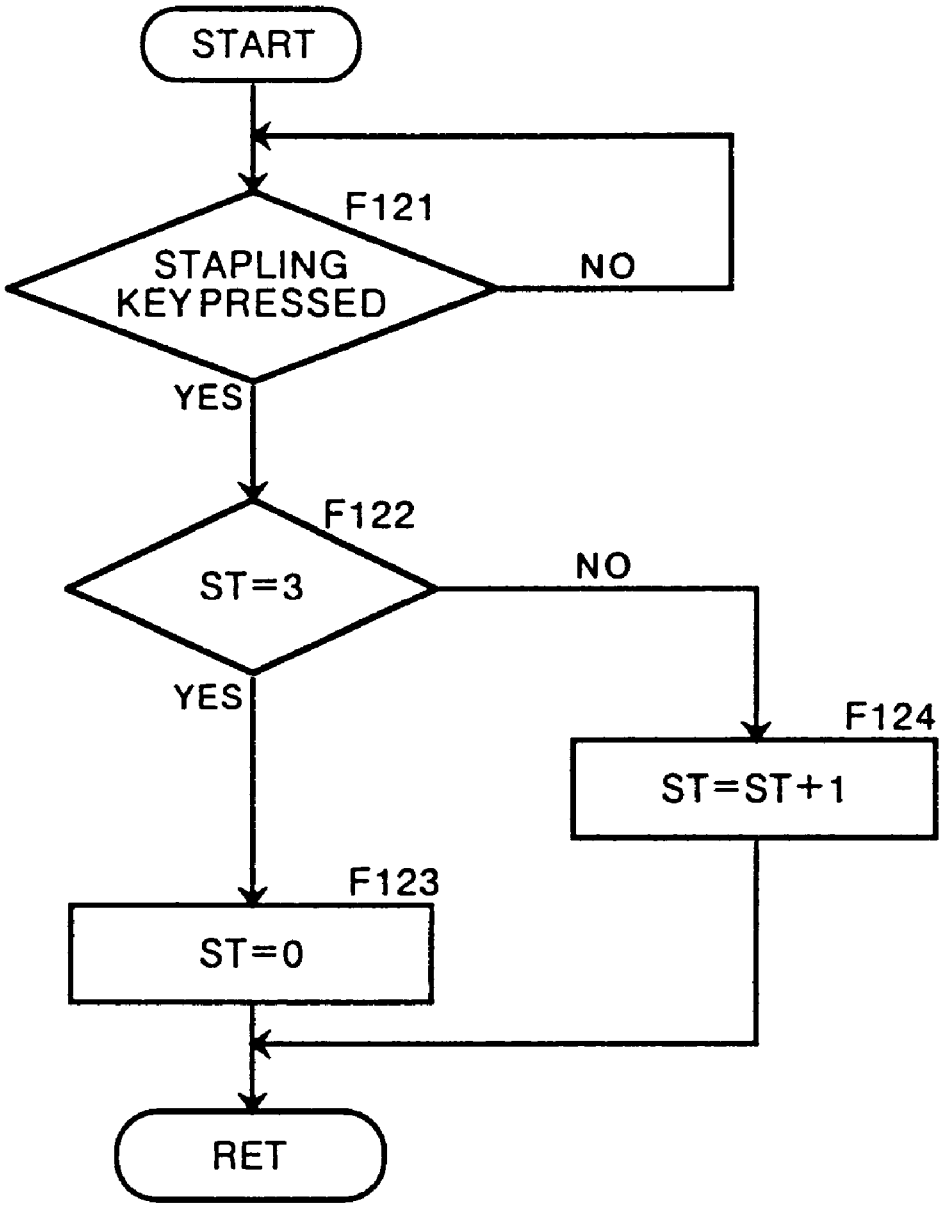
FIG. 11 is a flow chart for illustrating the automatic stapling mode setting processing.

FIG. 11 is a flow chart for illustrating in detail the processing to be executed in step F97 of FIG. 8. When the stapling key 61 is pressed (step F121=YES) and it is determined in step F122 that ST=3, the register ST is changed to "0" to change the mode to the non-stapling mode in step F123. When it is determined in step F122 that ST≠3, the value of the register MD is incremented by 1 in step F124. That ST=1 represents single stapling at a lower portion, that ST=2 represents double stapling at the middle and that ST=3 represents single stapling at an upper portion. The initial value of the register ST is set to "0".

Figure 12:
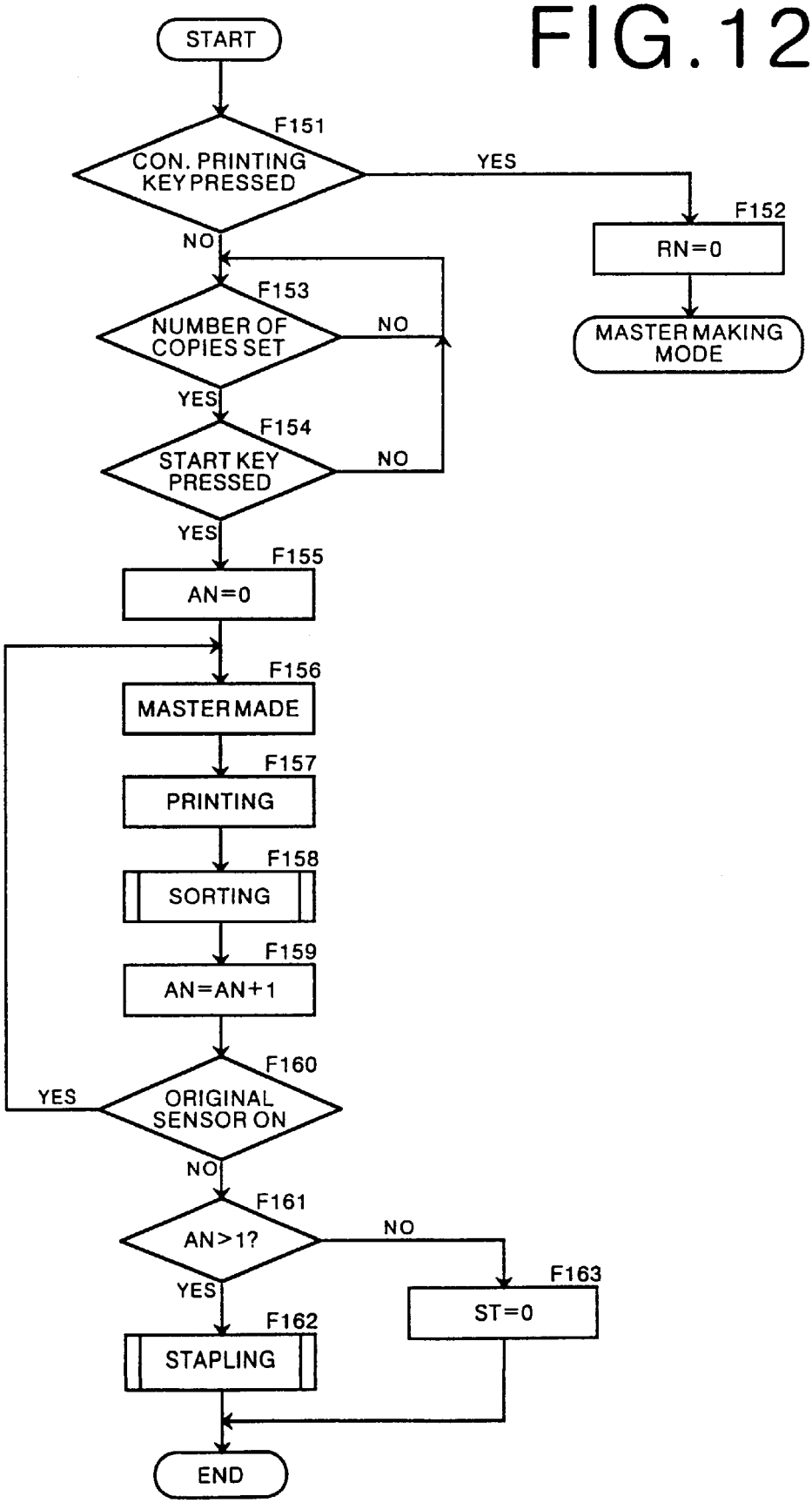
FIG. 12 is a flow chart for illustrating the processing during sorting mode printing.

FIG. 12 is a flow chart for illustrating the processing during sorting mode printing with the automatic stapling mode on. First it is determined in step F151 whether the continuous printing key 75 is pressed. In this case, since the continuous printing mode has been selected (a register RN has been set to "1") and the continuous printing LED 65 has been lit, the user presses the continuous printing key 75 to cancel the continuous printing mode. Accordingly when it is determined in step F151 that the continuous printing key 75 is pressed, the register RN is changed to "0" in step F152 and the mode is set to the master making mode. When it is determined in step F151 that the continuous printing key 75 is not pressed, it determined in step F153 that the number of copies to be printed has been set and it is determined in step F154 that the start key 71 is pressed, register AN for counting the number of stencil masters which has been made by use of the automatic document feeder 413 is set to "0" in step F155. Then making stencil masters is started in step F156. After the end of the master making, printing operation of the stencil printer unit 1 and sorting operation of the sheet sorter 2 are effected in parallel under the control of the CPU 90. (steps F157 and F158) Then after the ends of these operations, the value of the register AN is increment by one in step F159. Steps F156 to F159 are repeated until the originals in the automatic document feeder 413 are nullified, that is, the second original sensor 436 is turned off. (step F160) After the second original sensor 436 is turned off, it is determined in step F161 whether the value of the register AN is larger than 1. When it is determined that the value of the register AN is larger than 1, stapling is effected in step F162.

When the value of the register AN is not larger than 1, that is, AN=1 or 0, the register ST is set to 0 to inhibit stapling. (step F163) That is, that AN=0 represents that printing has been effected without use of the automatic document feeder 413 and stapling should not be effected. Further, that AN=1 represents that only a single original is set to the automatic document feeder 413 and it is not necessary to staple a single copy.

Figure 13:
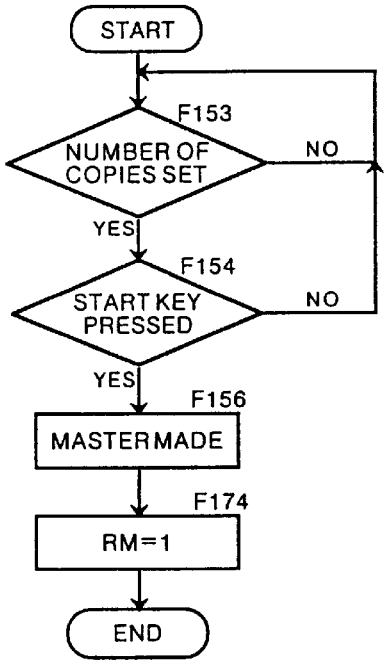
FIG. 13 is a flow chart for illustrating the processing during master making.

FIG. 13 is a flow chart for illustrating the processing during master making with the continuous printing mode off. When it is determined that the number of copies to be printed has been set (F171=YES) and the start key has been pressed (F172=YES), master making is effected in step F173. After the end of master making, the register RM is changed to "1" to switch the mode to the printing mode. (step F174)

Figure 14:
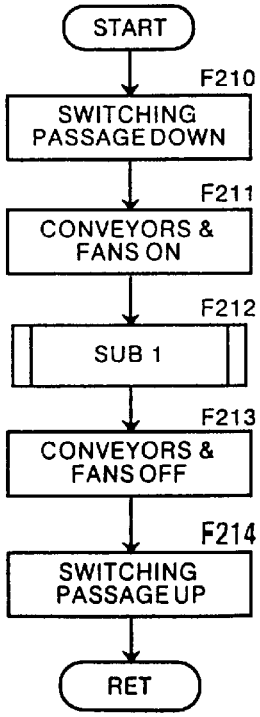
FIG. 14 is a flow chart for illustrating the processing during sorting.

FIG. 14 is a flow chart for illustrating in detail the processing to be executed in step F158 of FIG. 12. In step F210, the switching passage 31 is moved down to the position shown by the solid line in FIG. 4 so that the copies P are conveyed to the sheet sorter 2. Then the conveyor belts 24 and 25 and the suction fans 28 and 29 are started in step F211. Thereafter, as will be described in detail, the copies P are distributed to the bins in the bin array 21. (subroutine 1: step F212) Then after all the copies 1 are distributed to the bins, the conveyor belts 24 and 25 and the suction fans 28 and 29 are stopped in step F213 and the switching passage 31 is moved up to the position shown by the broken line in FIG. 4 in step F214.

Figure 15:
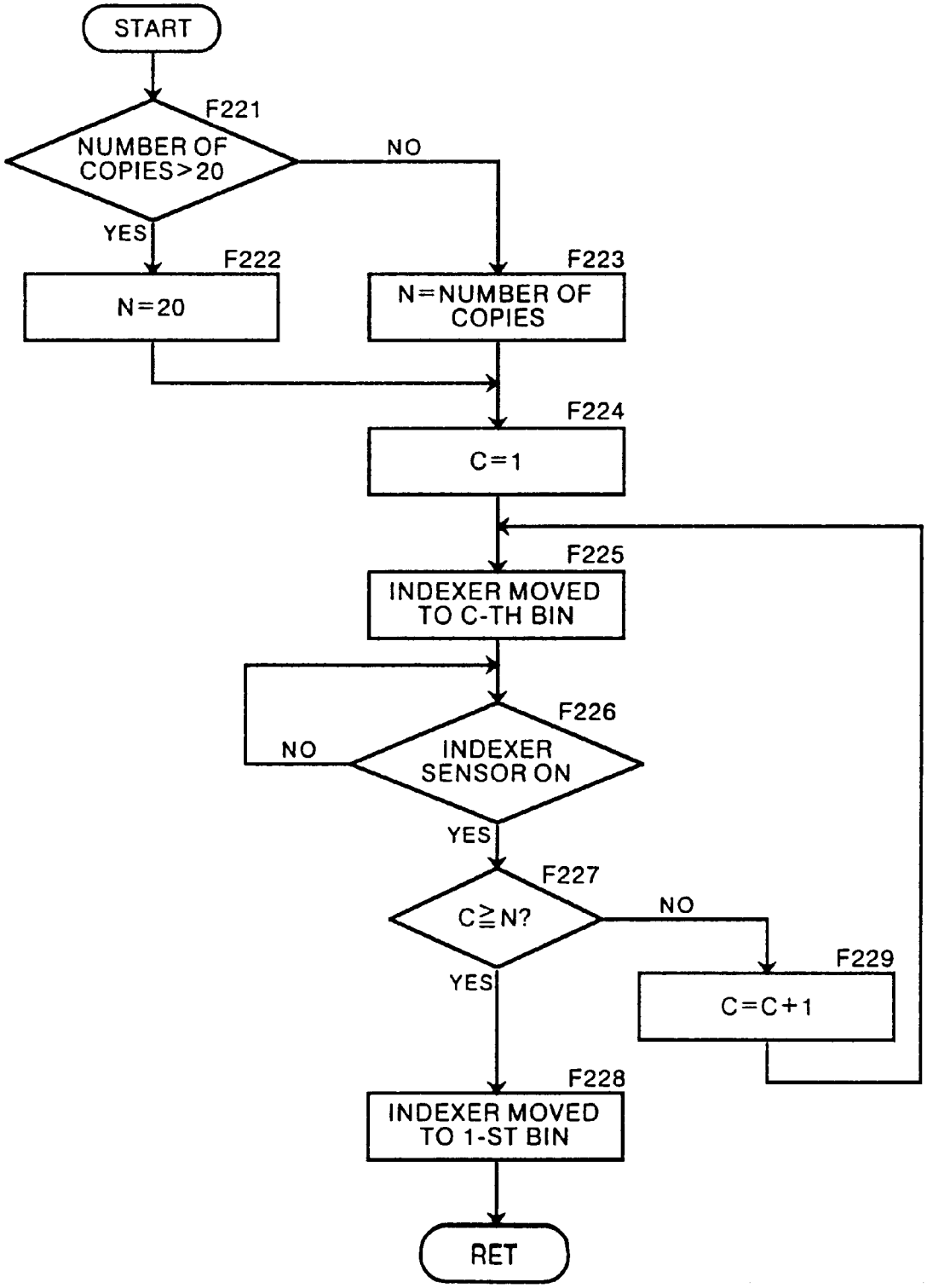
FIG. 15 is a flow chart for illustrating the subroutine to be executed in step F212 in FIG. 14.

FIG. 15 is a flow chart for illustrating the subroutine to be executed in step F212 in FIG. 14. In step F221, it is determined whether the number copies to be printed for each original is larger than the number of bins in the bin array 21 (20 in this particular embodiment). When the former is larger than the latter, register N is set to 20 in step F222 and otherwise the register N is set to the number copies to be printed for each original in step F223. Then in step F224, register C is set to 1. Thereafter the indexer 22 is moved to C-th bin (the first bin at this time) in step F225. Thereafter after the copy P is surely inserted into C-th bin (indexer sensor 23 on in step F226) and the indexer 22 is moved to (C+1)-th bin. (steps F227, F229 and F225) Then steps F225 and F226 are repeated until the value of the register C becomes equal to the value of the register N (F227=YES). Then when the value of the register C becomes equal to the value of the register N, the indexer 22 is moved to the first bin. (step F228).

Figure 16:
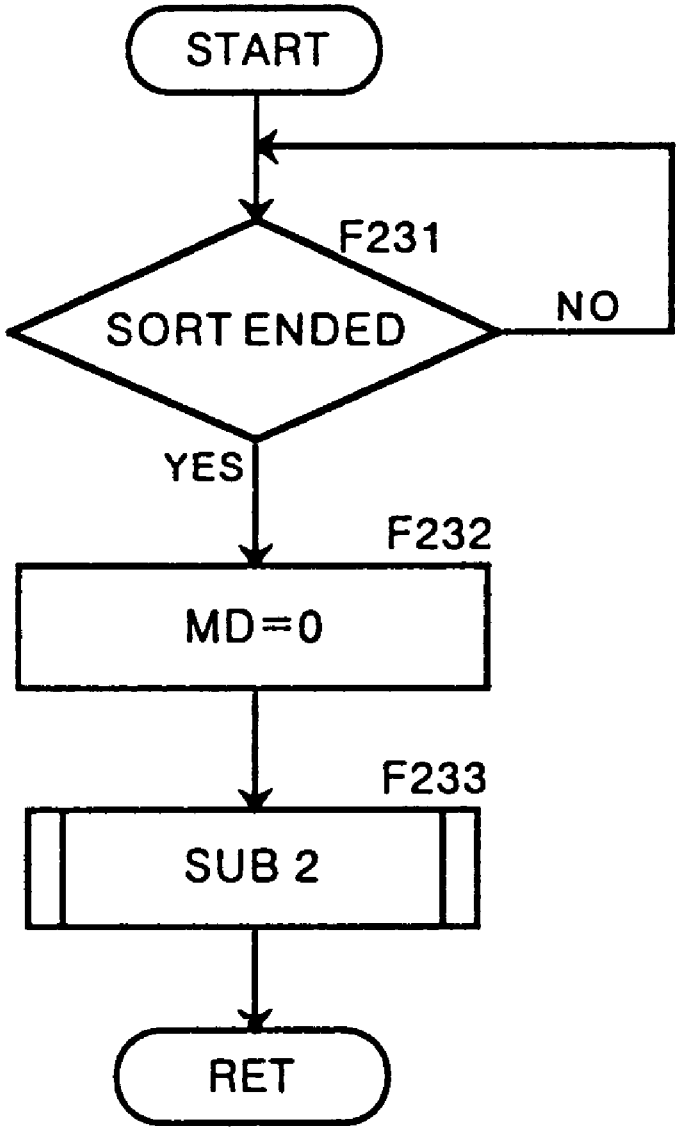
FIG. 16 is a flow chart for illustrating the processing during stapling.
Figure 17:
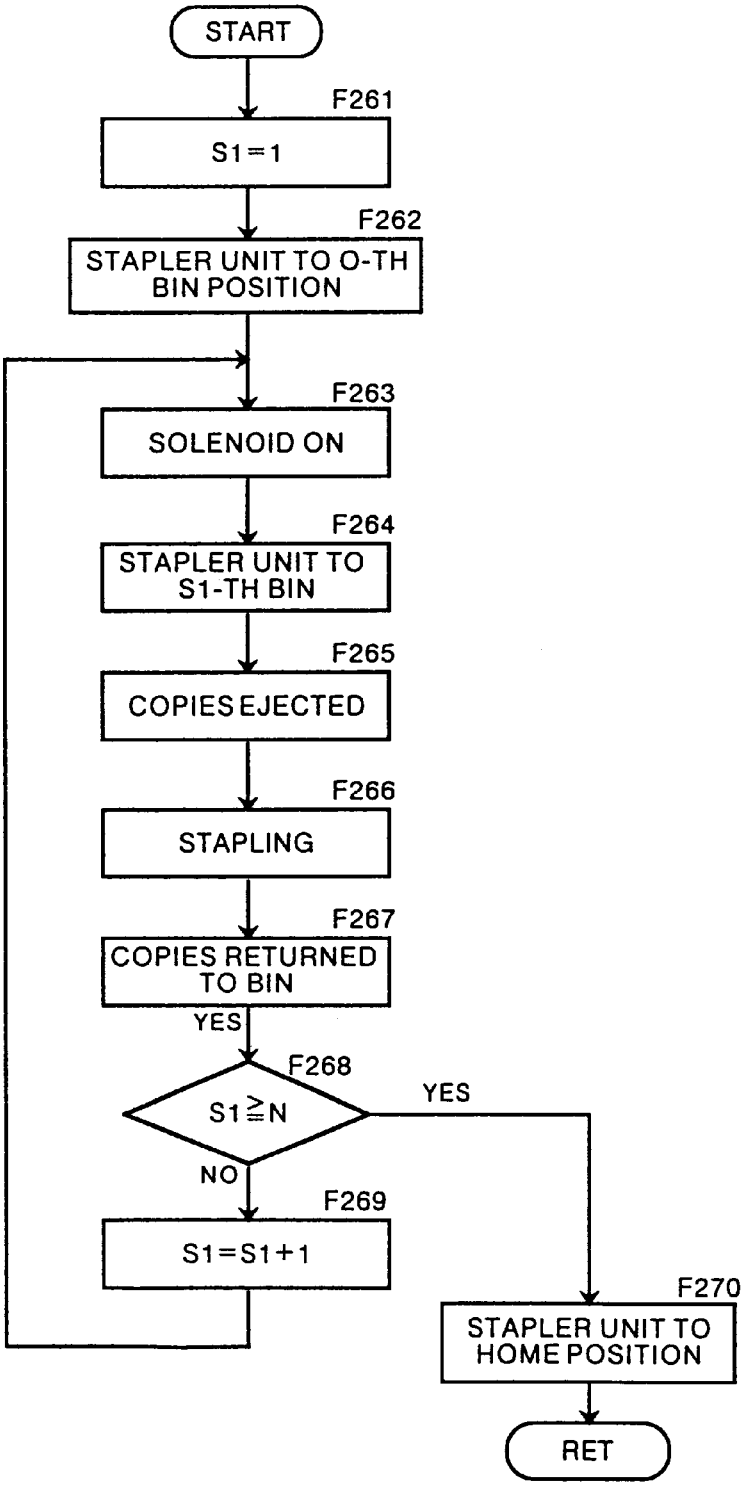
FIG. 17 is a flow chart for illustrating the subroutine to be executed in step F233 in FIG. 16.

FIG. 16 is a flow chart for illustrating the processing during stapling (step F162 in FIG. 12). First it is determined in step F231 whether sorting is completed. When it is determined that sorting is completed, the value of the register MD is changed to "0" to set the mode to the non-sort mode in step F232 and then the subroutine 2 shown in FIG. 17 is executed in step F233. Whether sorting is completed is determined by the CPU 90 by detecting whether step F214 in FIG. 14 is completed.

FIG. 17 is a flow chart for illustrating the subroutine to be executed in step F233 in FIG. 16. First register S1 is set to "1" in step F261. The value of the register S1 represents the number of the bins for which stapling has been effected. Then the stapler unit 35 is moved to "the 0-th bin position" in step F262. Before the stapler unit 35 is moved to "the 0-th bin position", the indexer 22 is retracted to the uppermost position not to interfere with the stapler unit 35. Then the solenoid 37 is turned on in step F263 and the stapler unit 35 is lowered to the S1-th bin with the solenoid 37 held on (step F264), whereby the erected face 21*a* of the first bin is rotated to the horizontal position. Thereafter the ejector 53*a* on the lineup rod 53 is moved to the S1-th bin and the ejector 53*a* ejects the stack of the copies P toward the stapler unit 35. (step F265) The stapler 34 staples the copies P ejected by the ejector 53*a*. (step F266) After the copies P are stapled, the pusher 36 pushes the stapled copies P back into the bin in step F267. Thereafter when the value of the register S1 is smaller than the value of the register N (step F268=NO), the value of the register S1 is incremented by 1 in step F269 and steps F263 to F267 are repeated. When the value of the register S1 becomes not smaller than the value of the register N, that is, when all the stacks of the copies are stapled, the stapler unit 35 is returned to the home position (e.g., the lowermost position)(step F270) and stapling is ended. Even if the sorter mode key 60 is pressed while steps F261 to F270 are executed, the CPU 90 cancels the signal from the sorter mode key 60 and does not permit switching of the sorter mode. Accordingly the switching passage 31 cannot be moved during stapling.

Though, in the embodiment described above, the switching passage 31 is employed as the means for switching the destination of the copies P, the non-sort discharge table 483 or the sheet sorter 2, such a switching means need not be limited to the switching passage 31. For example, with the switching passage 31 in FIG. 3 fixedly positioned in the position shown by the solid line, a movable flap may be provided between the stencil printer unit 1 and the passage 31 so that the copies P are selectively conveyed to the non-sort discharge table 483 or the conveyor belt 24 according to the inclination of the flap.

What is claimed is:

1. A stencil printer system comprising a stencil printer unit including a master making means for making a stencil master on the basis of an image read out from an original, a printing means for winding the stencil master around a printing drum and making copies of the original by transferring ink to printing sheets through the stencil master, an original conveyor means for conveying originals placed in a predetermined position to the mater making means one by one and discharging each of the originals from the master making means after the image thereon is read out, and an original detecting means for detecting whether an original exists in the predetermined position, a post handling unit including a sorting means for distributing the copies of the originals discharged from the stencil printer unit to a plurality of bins and forming a stack of the copies in each bin and a stapling means for stapling the stack of the copies in each bin, a first mode setting means manually operable for setting the stencil printer unit to a continuous printing mode in which the stencil printer unit repeats making a stencil mater on the basis of an image read out from an original and printing copies of the original for a plurality of originals placed in the predetermined position, a second mode setting means manually operable for setting the post handling means to one of a stapling mode for effecting stapling the stack of the copies in each bin and a non-stapling mode for not effecting stapling the stack of the copies, and a control means for automatically causing the first mode setting means to set the stencil printer unit to the continuous printing mode in response to the second mode setting means being operated to set the post handling means to the stapling mode.

2. A stencil printing system as defined in claim 1 wherein a counting means for counting the number of the originals placed in the predetermined position is provided and the control means inhibits the post handling unit from effecting stapling the stack of the copies when the number of the originals counted by the counting means is one even if the second mode setting means has been operated to set the post handling means to the stapling mode.

3. A stencil printing system as defined in claim 1 wherein, in the continuous printing mode, the stencil printer unit repeats making a stencil master and printing copies so long as the original detecting means detects existence of an original in the predetermined position.

4. A stencil printer system comprising a stencil printer unit including a master making means for making a stencil master on the basis of an image read out from an original, a printing means for winding the stencil master around a printing drum and making copies of the original by transferring ink to a printing sheets through the stencil master, an original conveyor means for conveying originals placed in a predetermined position to the master making means one by one and discharging each of the originals from the mater making means after the image thereon is read out, and an original detecting means for detecting whether an original exists in the predetermined position, a post handling unit including a sorting means for distributing the copies of the originals discharged from the stencil printer unit to a plurality of bins and forming a stack of the copies in each bin and a stapling means for stapling the stack of the copies in each bin, a first mode setting means manually operable for setting the stencil printer unit to a continuous printing mode in which the stencil printed unit repeats making a stencil master on the basis of an image read out from an original and printing copies of the original for a plurality of originals placed in the predetermined position, a second mode setting means manually operable for setting the post handling means to one of a stapling mode for effecting stapling the stack of the copies in each bin and a non-stapling mode for not effecting stapling the stack of the copies, and a control means for automatically causing the first mode setting means to set the stencil printer unit to the continuous printing mode in response to the second mode setting means being operated to set the post handling means to the stapling mode and the original detecting means detects that an original exists in the predetermined position.

* * * * *